US005577855A

United States Patent [19]

Leyden et al.

[11] Patent Number: 5,577,855

[45] Date of Patent: Nov. 26, 1996

[54] ANCHORING SYSTEM FOR SECURITY CABLE

[75] Inventors: Roger J. Leyden, Willow Springs; Terrance Surma, Bloomingdale, both of Ill.

[73] Assignee: Se-Kure Controls, Inc., Franklin Park, Ill.

[21] Appl. No.: 494,362

[22] Filed: Jun. 23, 1995

[51] Int. Cl.[6] ..... E05B 73/00

[52] U.S. Cl. ..... 403/291; 403/20; 403/329; 403/300; 248/222.11; 248/551

[58] Field of Search ..... 439/133, 304; 403/291, 19, 20, 300, 329, 330; 24/704.1, 615, 616; 70/58, 18; 248/222.11, 27.3, 551

[56] References Cited

U.S. PATENT DOCUMENTS

| | | | |
|---|---|---|---|
| 3,664,163 | 5/1972 | Foote | 70/58 |
| 3,859,826 | 1/1975 | Singer et al. | 70/58 |
| 4,615,575 | 10/1986 | Kossor | 439/304 |
| 5,050,836 | 9/1991 | Makous | 70/58 X |
| 5,172,098 | 12/1992 | Leyden et al. | 340/568 |
| 5,190,466 | 3/1993 | McVey | 439/304 |
| 5,293,668 | 3/1994 | Tibiletti | 24/704.1 X |
| 5,340,324 | 8/1994 | Fields et al. | 439/133 |

*Primary Examiner*—Anthony Knight

*Attorney, Agent, or Firm*—Wood, Phillips, VanSanten, Clark & Mortimer

[57] ABSTRACT

A system for anchoring a cable to a support. The anchoring system has a fitting for attachment to a cable to be anchored and a receiver for the fitting. Structure is provided for connecting the receiver to a support. Structure cooperates between the fitting and receiver for maintaining the fitting in an anchored state on the receiver. The structure for connecting the receiver to a support includes an anchor element having an operating portion that is manipulatable to selectively a) effect connection of the receiver to a support in an operative position and b) release the receiver from the operative position. The structure cooperating between the fitting and receiver blocks access to the operating portion of the anchor element with the fitting in the anchored state on the receiver to prevent release of the receiver from the operative position.

20 Claims, 3 Drawing Sheets

ANCHORING SYSTEM FOR SECURITY CABLE

BACKGROUND OF THE INVENTION

1. Field of the Invention

This invention relates to security systems as used to prevent unauthorized removal of discrete, portable articles, as from a display area, and, more particularly, to a system for anchoring a restraining cable on each article to a support.

2. Background Art

The cost of thievery in retail sales facilities is exceptionally high. This problem is aggravated by the growth of high volume electronic and appliance stores which display, in some cases, hundreds of different consumer articles of the type that can be removed from the display premises, undetected on the person of the thief.

Purveyors of electronic equipment commonly balance the competing objectives of encouraging sales and controlling theft. On the one hand, it is desirable to allow consumers to pick up, inspect, and in some cases operate a device, such as a camcorder. By permitting this inspection and trial use, sales of a particular product might be increased. To allow this complete inspection and operation, the articles are commonly individually connected to a flexible security cable connected at one end to a fixed support or a control box and at the other end to the particular article. The cord has sufficient length to allow the article to be removed from the display and manipulated by the user in normal fashion. On the other hand, by being able to remove the article from the shelf, the user is given the opportunity to discretely breach the security system and carrying off the article.

Several systems are currently offered by the assignee herein to prevent undetected removal of the security cable from either the article or support or severance of the cable. In U.S. Pat. No. 5,172,098, a highly commercially successful electronic system is disclosed to simultaneously monitor a plurality of articles. Sophisticated setup and monitoring circuits are designed into this system to afford a high level of security.

However, oft times it is desirable to secure a relatively limited number of articles through a less sophisticated, principally mechanical system. The desire for this mechanical system may be dictated by goals of simplicity and/or economy. The seller may not wish to contend with a maze of wires, emanating one per article from a control box in most electronic systems.

One existing mechanical security system uses what is termed in the industry a "slot wall". The wall includes frame elements, each having a slot into which a receiver for a cable end can be directed. A repositionable anchor element/plate can be directed rearwardly through the frame element with the plate in an assembly orientation on the receiver and repositioned through a front access to a locked position wherein the slot wall frame is captive between the plate and the receiver. As long as the cable end is attached to the receiver and the receiver plate is in the locked position, the cable end is positively anchored to the slot wall. However, in this conventional system, the receiver plate can be repositioned or removed simply by mining a bolt or similar element carrying the plate. That is, the system may be defeated by using a tool, such as a screwdriver, at the front of the receiver and repositioning the plate, whereby the receiver, cable and object tethered thereto can be removed as a unit by the thief, compacted, and carded discretely from the premises.

In short, in this type of system, generally effectiveness is compromised in the interest of convenience.

SUMMARY OF THE INVENTION

In one form of the invention, a system is provided for anchoring a cable to a support. The anchoring system has a fitting for attachment to a cable to be anchored and a receiver for the fitting. Structure is provided for connecting the receiver to a support. Structure cooperates between the fitting and receiver for maintaining the fitting in an anchored state on the receiver. The structure for connecting the receiver to a support includes an anchor element having an operating portion that is manipulatable to selectively a) effect connection of the receiver to a support in an operative position thereon and b) release the receiver from the operative position. The structure cooperating between the fitting and receiver blocks access to the operating portion of the anchor element with the fitting in the anchored state on the receiver to thereby prevent release of the receiver from the operative position.

In one form, the structure cooperating between the fitting and receiver releasably maintains the fitting in the anchored state on the receiver.

The structure cooperating between the fitting and receiver may allow the fitting to be moved from a first state wherein the fitting is fully separated from the receiver, to the anchored state by moving the fitting from the first state against and guidingly relative to the receptacle into the anchored state.

In one form, the cooperating structure includes a first shoulder on one of the fitting and receiver and deflectable tab on the other of the fitting and receiver and defining a second shoulder that confronts the first shoulder with the fitting in the anchored state on the receiver.

Structure is provided on one of the fitting and receiver for deflecting the tab on the other of the fitting and receiver as the fitting is advanced from the first state into the anchored state.

The deflectable tab has an engaged position in which the tab resides with the fitting in the anchored state on the receiver and a disengaged position in which the fitting can be placed into and removed from the anchored state. There is an opening in the receiver for accepting a tool to allow the tool to be directed into the opening and against the deflectable tab to facilitate repositioning of the tab between its engaged and disengaged positions.

With the inventive structure, it is possible to pre-attach the receptacle to a suitable support and to conveniently press fit the fitting into the anchored state.

In one form, the deflectable tab has a receptacle for the tool directed through the opening of the receiver.

In one form, with the fitting in the anchored state, the receiver bridges the receptacle on the deflectable tab so that the receptacle is substantially fully surrounded by the deflectable tab and receiver.

A U-shaped notch can be provided in the tab to define the receptacle.

In one form, the tab is movable in a first direction between its engaged and disengaged positions and the U-shaped notch opens oppositely to the first direction.

In one form, with the fitting in the anchored state and fully surrounded by the deflectable tab and receiver, the receptacle has a substantially circular cross section with a diameter. While the diameter can be virtually any size, it is preferred that the diameter be less than 1/16 of an inch and more preferably less than 1/32 of an inch.

The invention contemplates the above system in combination with a tool having an elongate body with a substantially circular cross section that can be directed through the receiver opening and against the deflectable tab with the fitting in the anchored state.

The invention further contemplates the above system in combination with an elongate cable, with structure for fixedly securing the cable to the fitting.

In one form, the receiver has an undercut opening, with the operating portion of the anchor element residing in the undercut opening. With the fitting in the anchored state, the fitting extends into the undercut opening and blocks access to the operating portion of the anchoring element.

The invention further contemplates the above system in combination with a support for the anchoring system, which support includes a frame element with a slot, with the anchor element including a pivotable plate that is extendable in a first direction through the slot with the plate in a first orientation and repositionable through the operating portion to a second orientation wherein the pivotable plate cannot be separated from the frame element by movement oppositely to the first direction.

Accordingly, with the receiver pre-attached to the support, simple placement of the fitting in its anchored state prevents access to the portion of the anchor element which would allow separation of the receiver from the support.

In one form, the receiver has a projection that extends into the slot in the frame element with the receiver in an operative position on the support.

The receiver may be made up of an adapter and a main part. The structure for connecting the receiver to a support connects the adapter to a support and connects the main receiver part in turn to the receiver adapter. The receiver adapter may have a flat wall that is attachable to any flat surface as through the use of a double-sided adhesive.

The structure for connecting the main receiver part to the receiver may include a projection on the main receiver part and a receptacle for the projection on the adapter. The invention further contemplates the combination of the above structure with a frame having a slot therein, with the projection on the main receiver fitting in the slot. The structure connecting the receiver to the support connects the receiver main part to the frame part on the support such that the receiver main part can be selectively connected directly to the support or indirectly to the support through the receiver adapter.

In another form of the invention, a system is provided for anchoring a cable to a support. The anchoring system includes a fitting for attachment to a cable to be anchored, a receiver for the fitting and structure cooperating between the fitting and receiver for removably maintaining the fitting in an anchored state on the receiver. The cooperating structure may include a first shoulder on one of the fitting and receiver and a deflectable tab on the other of the fitting and receiver and defining a second shoulder that confronts the first shoulder fully within the receiver with the fitting in the anchored state on the receiver and the tab in an engaged position. The tab is repositionable to a disengaged position wherein the fitting can be separated out of its anchored state from the receiver. An opening is provided in the receiver. A tool having a body that fits within the opening is useable to engage the tab and allow repositioning of the tab from its engaged position into its disengaged position.

DETAILED DESCRIPTION OF THE DRAWINGS

Figure 1:
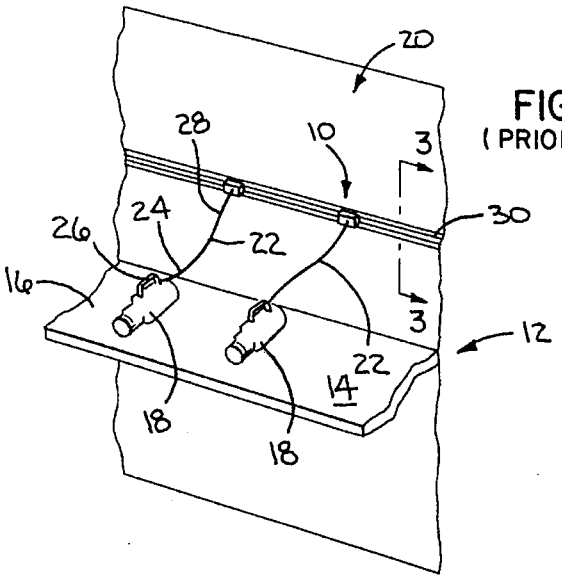
FIG. 1 (PRIOR ART)
FIG. 1 is a fragmentary, perspective view of a conventional point of purchase display, including a shelf for supporting discrete articles being displayed and a slot wall for anchoring the end of a cable attached one each to the articles.
Figure 2:
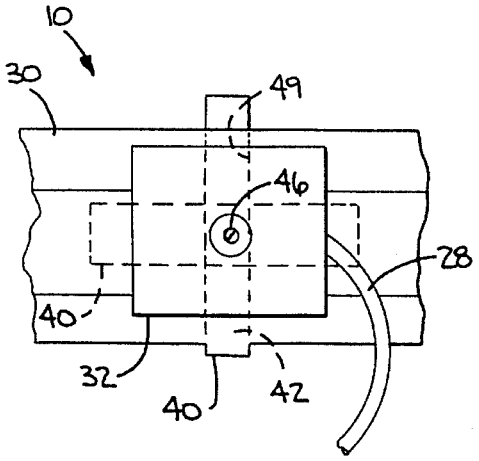
FIG. 2 (PRIOR ART)
FIG. 2 is an enlarged, front elevation view of a conventional receiver for a cable end and anchored to a frame element on the slot wall.
Figure 3:
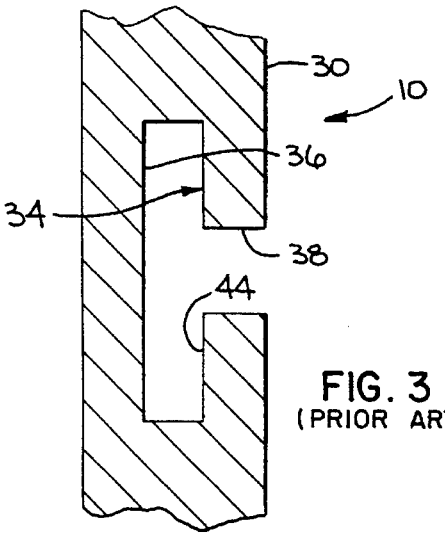
FIG. 3 (PRIOR ART)
FIG. 3 is an enlarged, cross-sectional view of the frame element on the slot wall taken along line 3—3 of FIG. 1.
Figure 4:
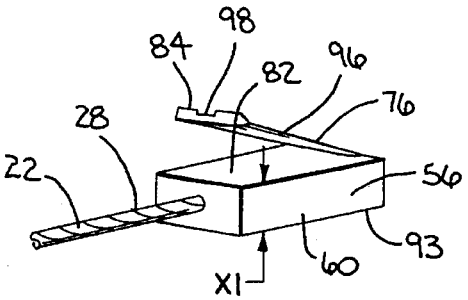
FIG. 4 is a perspective view of a cable with a fitting, according to the present invention, on an end thereof.
Figure 5:
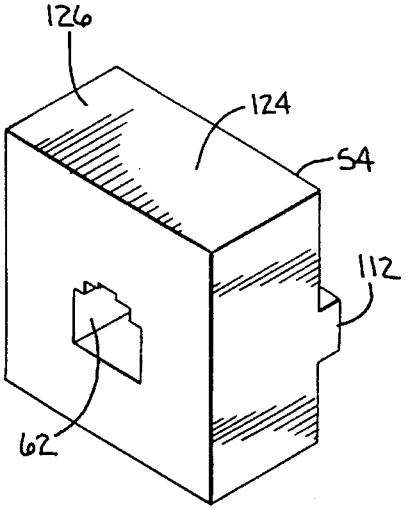
FIG. 5 is a perspective view of a receiver, according to the present invention, for the cable fitting of FIG. 4.

In FIGS. 1–3, a conventional system for anchoring a cable to a support is shown at 10 on a point of purchase display, shown generally at 12. The display 12 includes a shelf 14 with a flat, upwardly facing surface 16 for supporting merchandise to be displayed. In this case, camcorders 18 are shown supported on the shelf 14. The camcorders 18 are connected to a slot wall 20 through a cable 22. One cable end 24 is shown to lasso a handle 26 on the camcorder 18, with the opposite cable end 28 being anchored to the slot wall 20.

To facilitate connection of the cable end 28, the slot wall 20 is provided with slotted frame elements 30 (one shown). The frame element 30 is constructed to releasably accept a receiver 32 to which the cable end 28 is fixed.

More particularly, the frame element 30 has a T-shaped slot 34, as viewed in cross section, and clearly seen in FIG. 3. The slot 34 includes a cross bar section 36 and an entry stem section 38.

The receiver 32 has an associated anchor element/plate 40 that is repositionable selectively between the solid line position in FIG. 2 and the dotted line position in FIG. 2. With the anchor element 40 in the dotted line position of FIG. 2, the anchor element 40 can be directed through the entry section 38 of the slot 34 so that it coincides with the cross bar section 36. By then repositioning the anchor element 40 to the solid line position in FIG. 2, the forwardly facing surface 42 of the anchor element 40 is placed in confronting relationship with the rearwardly facing surface 44 bounding the cross bar section of the slot 34. With the anchor element 40 in the solid line position of FIG. 2, the receiver 32 is prohibited from being drawn forwardly to be separated with the cable 22 away from the slot wall 20.

A screw/bolt 46 extends through the receiver 32 and threadably connects to the anchor element 40. The screw/bolt 46 can be used to progressively draw the anchor element 40 forwardly to cause an increasing captive holding force to be developed between the anchor element 40 and receiver 32 on the frame element 30. A stop 49 is defined on the frame element 30 to limit, in FIG. 2, clockwise pivoting of the anchor element 40 to thereby allow the screw/bolt 46 to be tightened without manually holding the plate 40 against taming. By loosening the screw/bolt 46, the anchor element 40 can be loosened and repositioned to the dotted line position of FIG. 2 to allow separation of the receiver 32 and anchor element 40 as a unit from the frame element 30.

It can be seen that by using, in this case, a screwdriver, the thief can simply release the receiver 32 from the slot wall 20. Once this occurs, the thief can conveniently coil the cable 22 and make off with the camcorder 18, together with the cable anchoring system, which is relatively unobtrusive.

Figure 11:
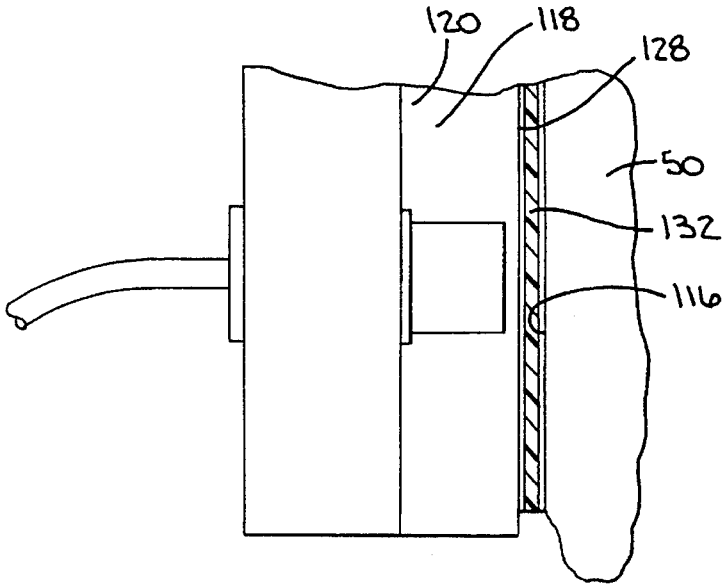
FIG. 11 is a side elevation view, partially in cross section, showing the inventive receiver and adapter operatively connected to a flat support and with a cable fitting in an anchored state on the receiver.
Figure 12:
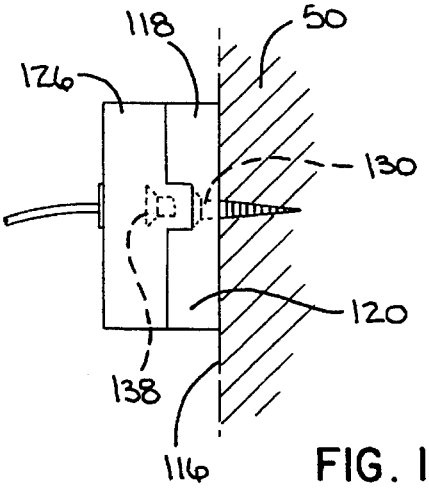
FIG. 12 is a reduced view similar to that in FIG. 11 and showing alternative ways of attaching the inventive anchoring system through the adapter to a support.

The inventive system for anchoring the cable 22 to a support, such as the slot wall 20 in FIG. 1, or another type of support, as shown at 50 in FIGS. 11 and 12, is shown in FIGS. 4–12. The inventive system will initially be described with respect to FIGS. 4–8 as it is used to connect the cable 22 to frame element 30 on the slot wall 20.

Figure 7:
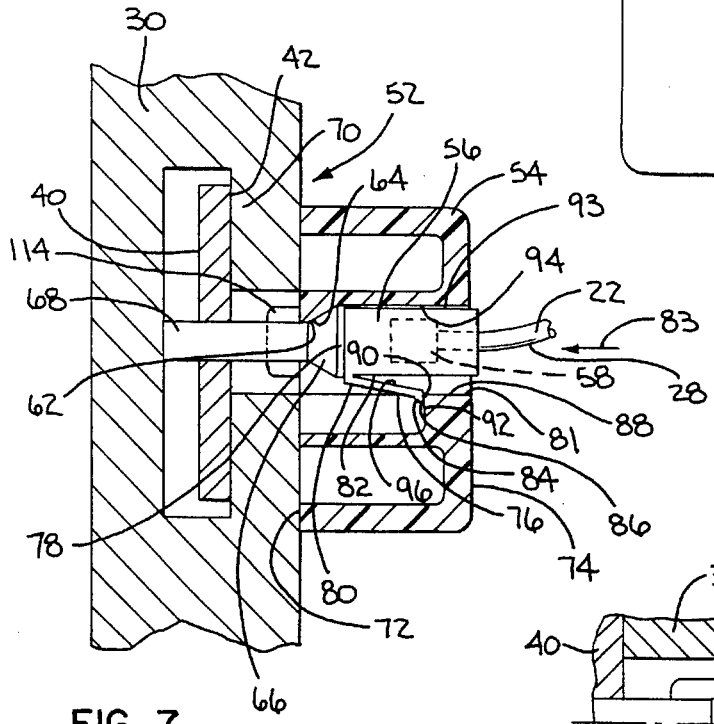
FIG. 7 is a cross-sectional view of the inventive cable anchoring system showing the receiver in an operative position on a conventional frame element as in FIG. 3 and the cable fitting in an anchored state on the receiver.

The inventive cable anchoring system, as shown at 52, consists of a receiver 54, which removably accepts a fitting 56 at the cable end 28. The cable end 28 can be connected fixedly to the fitting 56 in a number of different ways, well known to those skilled in the art. In FIG. 7, an enlarged anchor element 58 is crimped onto the cable end 28 and molded directly into the body 60 of the fitting 56. The manner of effecting this connection is not critical to the present invention.

The receiver 54 has an undercut opening 62 defining a recessed shoulder 64 conforming to the head 66 of a bolt 68 that extends into the opening 62 and fully through the receiver 54 to engage the anchor element 40, which cooperates with the slot 34, as in the prior art: described in FIGS. 1–3. By tightening the bolt 68, a wall 70 on the frame element 30 is caused to be captively held between the forward surface 42 of the strike element 40 and the rearwardly facing edge 72 of the receiver 54. The bolt head 66, through which the bolt 68 is either tightened to attach the receiver 54 or loosened to release the receiver 54 from the slot wall 20, resides fully within the opening 62, to be accessible only through the front wall 74 of the receiver 54.

According to the invention, the fitting 56, in the anchored state shown in FIG. 7, blocks access to the bolt head 66, thereby prohibiting release of the receiver 54 from the slot wall 20 so long as the fitting 56 is in the anchored state of FIG. 7.

To set up the,anchoring system 52, the user can place the anchor element 40 in a first orientation where it can be passed through the stem section 38 of the slot 34 and thereafter repositioned to the FIG. 7 orientation, whereupon the bolt 68 is tightened to secure this connection and thereby maintain the receiver 54 in an operative position on the supporting slot wall 20. The fitting 56 can then be press fit into the anchored state of FIG. 7, by structure described hereinafter.

Figure 8:
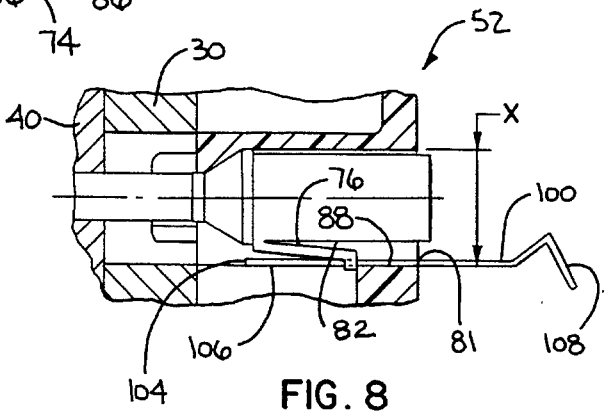
FIG. 8 is a view as in FIG. 7 and showing a tool, according to the present invention, inserted in an opening in the receiver to facilitate disengagement of the fitting.
Figure 9:
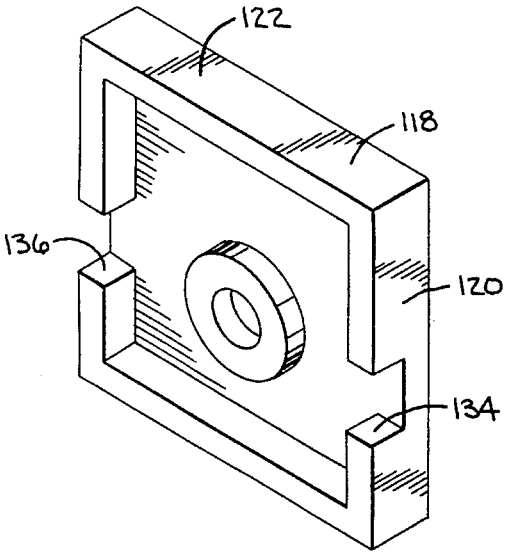
FIG. 9 is a perspective view of an optional adapter on the receiver for attaching the receiver as to a flat surface.
Figure 10:
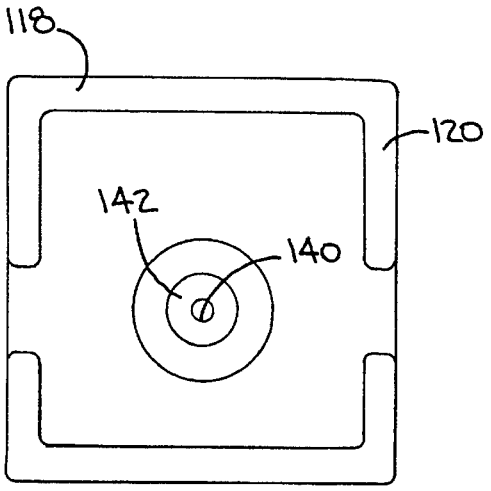
FIG. 10 is a front elevation view of the receiver in FIG. 9.

More particularly, the fitting 56 has a deflectable tab 76 integrally formed with a body 60 thereon to be bent towards and away from the body 60 between engaged and disengaged positions, shown in FIGS. 7 and 8, respectively. As the leading fitting edge 78 moves into and through the opening 62, the tab surface 80 comes into contact with an edge 81 on the receiver 54, which effects the necessary deflection of the tab 76, as further described below.

It is important that the fitting 56 be consistently introduced to the opening 62 so that it will properly anchor as in FIG. 7. To accomplish this, the fitting body 60 has a rectangular cross section, with the opening 62 in the receiver 54 having a complementary shape. The shorter dimension X of the opening 62 is slightly larger than the corresponding shorter dimension X1 of the body 60 on the fitting 56 to accommodate the tab 76. As the tab surface 80 encounters the edge 81 on the receiver 54, the edge 81 cams the tab 76 progressively towards the body surface 82. Continued right-to-left movement of the fitting 56, in the direction of the arrow 83 in FIG. 7, causes an offset end 84 on the tab 76 to ride over the edge 81 and thereby squeeze the tab 76 to closely adjacent the surface 82. Eventually, the tab 76 will reside fully within the opening 62, with the surface 86 on the offset tab end 84 riding guidingly on the receiver surface 88 bounding the opening 62. With the fitting 56 in the anchored state, the offset tab end 84 travels rearwardly beyond the end of the surface 88, and upon clearing the surface 88, springs back to the undeformed state of FIG. 4. As this occurs, a forwardly facing shoulder 90 on the tab 76 confronts a rearwardly facing shoulder 92 defined by the receiver 54 at the end of the surface 88. Since the surface 93 facing oppositely to the fitting surface 82 is in close proximity to the facing receiver wall 94 bounding the opening 62, the fitting 56 is prohibited from being dram out of its anchored state without deflecting the tab 76 from the engaged position of FIG. 7 back towards the body 60 of the fitting 56 to the disengaged position in FIG. 8.

It should also be noted that the shoulders 90, 92 reside fully within the opening 62 so that a would-be thief cannot see the tab 76 and is prohibited from easy access thereto as would allow repositioning of the tab 76 to release the fitting 56. When inserting a screwdriver or a like instrument between the surface 82 on the fitting 56 and the surface 88 on the receiver 54, the would-be thief would be in effect camming the tab 76 further into the engaged position by reason of causing the screwdriver or other tool to wedge against the tab surface 96.

According to the invention, a receptacle 98 is formed on the offset end 84 of the tab 76. The receptacle 98 is defined in one preferred form by a U-shaped notch. With the fitting 56 in the anchored state of FIG. 7, the receptacle 98 is bridged by the receiver surface 88 so that the receptacle 98 is essentially fully surrounded by the tab 76 and receiver 54. The only way to effectively reposition the tab 76 from the engaged position to the disengaged position is to direct a tool into the receptacle 98 and then pry the tab 76 toward the body 60 using the tool.

A suitable tool for this purpose is shown at 100 in FIG. 8. The tool 100 is a formed piece of wire having a circular cross section, with a diameter preferably no more than 1/16", and preferably no more than 1/32". A piece of piano wire is highly suitable for forming the tool 100.

Figure 6:
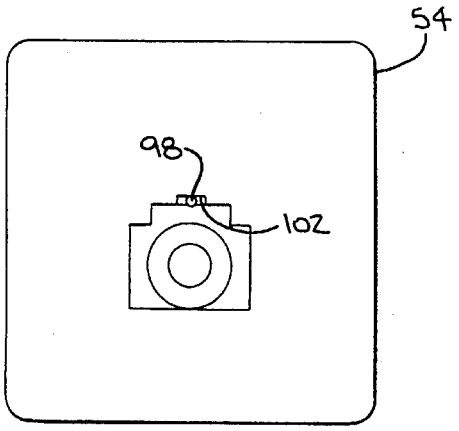
FIG. 6 is a front elevation view of the receiver of FIG. 5.

The opening 62 has a slight undercut 102 to accommodate the tool 100. As seen in FIG. 6, the receptacle 98 is exposed from the front of the receiver 54 to receive the circular end 104 of the body 106 of the tool 100. By directing the tab end 104 through the receptacle 98, the user can then reposition the proximal end 108 of the tool 100 to pry the tab 76 to the disengaged position in FIG. 8. With the tab 76 in the disengaged position, the offset end 84 of the tab 76 is shifted to the level of the surface 88, and can slide therealong to allow removal of the fitting 56 from the receiver 54.

The receiver 54 has spaced projections 112, 114 which can be directed into the stem section 38 of the slot 34. The projections 112, 114 thus serve a locating function and limit rotation of the receiver 54 as the bolt 68 is tightened.

It is also desirable in some environments to attach the receiver 54 to a flat support surface, as shown at 116 in FIGS. 11 and 12. To accomplish this, an adapter 118, as shown in FIGS. 9–12, is employed. The adapter 118 has a cup-shaped body 120 with a peripheral wall 122 corresponding to the shape of the peripheral wall 124 of the main part 126 of the receiver 54. The adapter 118 has a flat surface 128 that can be presented in parallel relationship to the support surface 116. The adapter 118 can be pre-attached to the support surface 116, as through the use of a screw, as shown at 130 in FIG. 12, or through the use of a double-sided adhesive tape 132, as shown in FIG. 11.

The projections 112, 114 on the main receiver part 126 nest in correspondingly shaped receptacles 134, 136 on the adapter 118. The main receiver part 126 can then be consistently located and secured to the body 120. In one form, a screw 138 is directed into the opening 62 and into a threaded bore 140 on a fitting 142 on the adapter 118 to hold the receiver part 126 fixedly on the adapter 118.

The operation of the system is the same whether or not the adapter 118 is used. The adapter 118 affords the versatility of permitting the universal receiver part 126 to be used directly on slot walls and, through the adapter 118 on flat surfaces, without significantly complicating the assembly process.

The foregoing disclosure of specific embodiments is intended to be illustrative of the broad concepts comprehended by the invention.

We claim:

1. A system for anchoring a cable to a support, said anchoring system comprising:

a fitting for attachment to a cable to be anchored;

a receiver for the fitting;

means for connecting the receiver to a support; and means cooperating between the fitting and receiver for releasably maintaining the fitting in an anchored state on the receiver as an incident of which a cable to which the fitting is attached is releasably anchored to the receiver, said connecting means including an anchor element having an operating portion that is manipulatable to selectively a) effect connection of the receiver to a support in an operative position thereon and b) release the receiver from the operative position, said means cooperating between the fitting and receiver comprising means for blocking access to the operating portion of the anchor element with the fitting in the anchored state on the receiver to thereby prevent access to the operating portion as would allow manipulation thereof to thereby release the receiver from the operative position, said means for blocking access being defined at least in part by the fitting.

2. The cable anchoring system according to claim 1 wherein the means cooperating between the fitting and receiver comprises means for allowing the fitting to be released from the anchored state on the receiver with the receiver in the operative position.

3. The cable anchoring system according to claim 1 wherein the means cooperating between the fitting and receiver comprises means for allowing the fitting to be moved from a first state, wherein the fitting is fully separated from the receiver, to the anchored state by moving the fitting from the first state against and guidingly relative to the receptacle into the anchored state.

4. The cable anchoring system according to claim 3 wherein the cooperating means comprises a first shoulder on one of the fitting and receiver and a deflectable tab on the other of the fitting and receiver and defining a second shoulder that confronts the first shoulder with the fitting in the anchored state on the receiver.

5. The cable anchoring system according to claim 4 wherein there are means on the one of the fitting and receiver for deflecting the tab on the other of the fitting and receiver as the fitting is advanced from the first state into the anchored state.

6. The cable anchoring system according to claim 5 wherein the deflectable tab has an engaged position in which the tab resides with the fitting in the anchored state on the receiver and a disengaged position in which the fitting can be placed into and removed from the anchored state, and there is an opening in the receiver for accepting a tool to allow the tool to be directed into the opening and against the deflectable tab to facilitate repositioning of the tab between its engaged and disengaged position.

7. The cable anchoring system according to claim 6 wherein the deflectable tab has a receptacle for a tool directed through the opening in the receiver with the fitting in its anchored state.

8. The cable anchoring system according to claim 7 wherein with the fitting in the anchored state the receiver bridges the receptacle on the deflectable tab so that the receptacle is substantially fully surrounded by the deflectable tab and receiver.

9. The cable anchoring system according to claim 8 wherein with the fitting in the anchored state and fully surrounded by the deflectable tab and receiver, the receptacle has a substantially circular cross section with a diameter.

10. The cable anchoring system according to claim 9 wherein the diameter of the receptacle is less than 1/16 inch.

11. The cable anchoring system according to claim 8 in combination with a tool having an elongate body with a substantially circular cross section that can be directed through the receiver opening and against the deflectable tab with the fitting in the anchored state.

12. The cable anchoring system according to claim 1 in combination with an elongate cable and means for fixedly securing the fitting to the cable.

13. The cable anchoring system according to claim 1 wherein the receiver has an undercut opening, the operating portion of the anchor element resides within the undercut opening, with the fitting in the anchored state the fitting extends into the undercut opening and blocks access to the operating portion of the anchor element, and with the fitting released from the operative position the operating portion of the anchor element is exposed through the undercut opening to be manipulated by a user to thereby be selectively placed in the operative position and released from the operative position.

14. The cable anchoring system according to claim 1 in combination with a support for the anchoring system, said support including a frame element with a slot, wherein the anchor element includes a pivotable plate that is extendable in a first direction through the slot with the plate in a first orientation and repositionable through the operating portion to a second orientation wherein the pivotable plate cannot be separated from the frame element by movement oppositely to the first direction.

15. The cable anchoring system according to claim 14 wherein the receiver has a fixed projection that extends into the slot in the frame element with the receiver in an operative position on the support.

16. The cable anchoring system according to claim 1 wherein the receiver comprises an adapter and a main part and the means for connecting the receiver to a support comprises means for connecting the adapter to a support and means for connecting the main receiver part to the receiver adapter.

17. The cable anchoring system according to claim 16 wherein the receiver adapter has a flat wall and the means for connecting the adapter to a support comprises a double-sided adhesive.

18. The cable anchoring system according to claim 17 wherein the means for connecting the main receiver part to the receiver adapter comprises a projection on the main receiver part and a receptacle for the projection on the adapter, there further being in combination with the cable anchoring system a support including a frame with a slot therein and the projection on the main receiver fits in the slot, wherein the means for connecting the receiver to the support comprises means for connecting the receiver main part to the frame on the support, whereby the receiver main part can be selectively connected directly to the support or indirectly to the support through the receiver adapter.

19. A system for anchoring a cable to a support, said anchoring system comprising:

a fitting for attachment to a cable to be anchored;

a receiver for the fitting;

means for connecting the receiver to a support; and means cooperating between the fitting and receiver for maintaining the fitting in an anchored state on the receiver, said connecting means including an anchor element having an operating portion that is manipulatable to selectively a) effect connection of the receiver to a support in an operative position thereon and b) release the receiver from the operative position, said means cooperating between the fitting and receiver comprising means for blocking access to the operating portion of the anchor element with the fitting in the anchored state on the receiver to thereby prevent release of the receiver from the operative position, wherein the means cooperating between the fitting and receiver comprises means for allowing the fitting to be moved from a first state, wherein the fitting is fully separated from the receiver, to the anchored state by moving the fitting from the first state against and guidingly relative to the receptacle into the anchored state, wherein the cooperating means comprises a first shoulder on one of the fitting and receiver and a deflectable tab on the other of the fitting and receiver and defining a second shoulder that confronts the first shoulder with the fitting in the anchored state on the receiver, wherein the cooperating means comprises a first shoulder on one of the fitting and receiver and a deflectable tab on the other of the fitting and receiver and defining a second shoulder that confronts the first shoulder with the fitting in the anchored state on the receiver, wherein there are means on the one of the fitting and receiver for deflecting the tab on the other of the firing and receiver as the fitting is advanced from the first state into the anchored state, wherein the deflectable tab has an engaged position in which the tab resides with the fitting in the anchored state on the receiver and a disengaged position in which the fitting can be placed into and removed from the anchored state, and there is an opening in the receiver for accepting a tool to allow the tool to be directed into the opening and against the deflectable tab to facilitate repositioning of the tab between its engaged and disengaged position, wherein the deflectable tab has a receptacle defined by a U-shaped notch for a tool directed through the opening in the receiver with the fitting in its anchored state, wherein the tab is movable in a first direction between its engaged and disengaged positions and the U-shaped notch opens oppositely to the first direction.

20. A system for anchoring a cable to a support, said anchoring system comprising:

a fitting for attachment to a cable to be anchored;

a receiver for the fitting;

means cooperating between the fitting and receiver for removably maintaining the fitting in an anchored state on the receiver.

wherein the cooperating means comprises a first shoulder on one of the fitting and receiver and a deflectable tab on the other of the fitting and receiver and defining a second shoulder that confronts the first shoulder at a location fully within the receiver with the fitting in the anchored state in the receiver and the tab in an engaged position.

said tab being repositionable to a disengaged position wherein the fitting can be separated out of its anchored state from the receiver;

an opening in the receiver; and a tool having a body that fits within the opening to engage the tab in its anchored state and allow repositioning of the tab from its engaged position into its disengaged position, wherein the deflectable tab has a notch therein to receive the tool body with the fitting in the anchored state, wherein with the fitting in the anchored state, the notch is bridged by the receiver so that the receiver and tab cooperatively bound a substantially closed receptacle for the tool body with the receptacle being aligned with the receiver opening so that the tool body can be directed through the receiver opening into the receptacle.

* * * * *